US009135862B2

(12) United States Patent
Park et al.

(10) Patent No.: US 9,135,862 B2
(45) Date of Patent: Sep. 15, 2015

(54) ORGANIC LIGHT EMITTING DISPLAY DEVICE AND METHOD FOR OPERATING THE SAME

(71) Applicant: LG Display Co., Ltd., Seoul (KR)

(72) Inventors: Jeong Hyo Park, Gunpo (KR); Byung Chul Ahn, Seoul (KR); Ho Min Lim, Goyang (KR)

(73) Assignee: LG Display Co., Ltd., Seoul (KR)

( * ) Notice: Subject to any disclaimer, the term of this patent is extended or adjusted under 35 U.S.C. 154(b) by 144 days.

(21) Appl. No.: 13/958,299

(22) Filed: Aug. 2, 2013

(65) Prior Publication Data

US 2014/0152633 A1 Jun. 5, 2014

(30) Foreign Application Priority Data

Dec. 3, 2012 (KR) ..... 10-2012-0139243

(51) Int. Cl.
*G09G 3/32* (2006.01)

(52) U.S. Cl.
CPC ..... *G09G 3/3291* (2013.01); *G09G 2300/0842* (2013.01); *G09G 2300/0861* (2013.01); *G09G 2310/0251* (2013.01); *G09G 2320/041* (2013.01); *G09G 2320/045* (2013.01); *G09G 2354/00* (2013.01)

(58) Field of Classification Search
CPC ..... G09G 2320/045; G09G 2320/0233; G09G 2320/0242; G09G 2300/043
See application file for complete search history.

(56) References Cited

U.S. PATENT DOCUMENTS

| | | | | |
|---|---|---|---|---|
| 6,518,561 | B1 * | 2/2003 | Miura | 250/221 |
| 6,552,735 | B1 * | 4/2003 | Dehmlow | 345/690 |
| 2009/0244044 | A1 | 10/2009 | Furuichi | |
| 2009/0309818 | A1 | 12/2009 | Kim | |
| 2011/0254871 | A1 | 10/2011 | Yoo et al. | |
| 2013/0342431 | A1 * | 12/2013 | Saeedi et al. | 345/89 |

FOREIGN PATENT DOCUMENTS

| | | | |
|---|---|---|---|
| JP | 2009-237194 | A | 10/2009 |
| JP | 2009-301037 | A | 12/2009 |
| JP | 2010-237528 | A | 10/2010 |
| JP | 2011-221480 | A | 11/2011 |

* cited by examiner

*Primary Examiner* — Kent Chang
*Assistant Examiner* — Nathan Brittingham
(74) *Attorney, Agent, or Firm* — Fenwick & West LLP

(57) ABSTRACT

Disclosed is an organic light emitting display device, which is capable of compensating for variations in the characteristics of driving transistors, comprising a display panel including a plurality of pixels, each pixel having a driving transistor for operating a light emitting device to make the light emitting device emit light with a data current corresponding to a data voltage; a panel driver for detecting the characteristics of the driving transistors including at least one of mobility and threshold voltage of the driving transistor included in each pixel during a time period when there exists no user around the display panel, generating compensated input data by compensating input data according to the characteristics after the detection of the characteristics is completed, and generating data voltage through the use of the compensated input data; and a sensor for sensing whether or not there exists a user around the display panel, and supplying the sensing result to the panel driver.

12 Claims, 11 Drawing Sheets

ORGANIC LIGHT EMITTING DISPLAY DEVICE AND METHOD FOR OPERATING THE SAME

CROSS REFERENCE TO RELATED APPLICATIONS

This application claims the benefit of Republic of Korea Patent Application No. 10-2012-0139243 filed on Dec. 3, 2012, which is hereby incorporated by reference as if fully set forth herein.

BACKGROUND

1. Field of the Invention

Embodiments of the present invention relate to an organic light emitting display device and a method for operating the same.

2. Discussion of the Related Art

According to a recent development of multimedia, there is an increasing demand for a flat panel display. In order to satisfy this increasing demand, various flat panel displays such as liquid crystal display, plasma display panel, and organic light emitting display are practically used. Among the various flat panel displays, the organic light emitting display device has attracted significant interest as a next-generation flat panel display owing to the advantages of rapid response speed and low power consumption provided by such displays. In addition, the organic light emitting display device can emit light in itself, whereby the organic light emitting display device does not cause a problem related with a narrow viewing angle.

Generally, the organic light emitting display device according to the related art may include a display panel having a plurality of pixels, and a panel driver for driving each of the pixels. In this case, each pixel is formed in a pixel region which is defined by the crossings of each of the plurality of gate lines and each of the plurality of data lines.

As shown in FIG. 1, each pixel may include a switching transistor ST, a driving transistor DT, a capacitor Cst, and an light emitting device OLED.

The switching transistor ST is switched by a gate signal GS supplied to a gate line G, thereby supplying a data voltage Vdata, which is supplied to a data line D, to the driving transistor DT.

The driving transistor DT is switched by the data voltage Vdata supplied from the switching transistor ST, thereby controlling a data current Ioled flowing from a driving power source VDD to the light emitting device OLED.

The capacitor Cst is connected between gate and source terminals of the driving transistor DT. The capacitor Cst stores a voltage corresponding to the data voltage Vdata supplied to the gate terminal of the driving transistor DT, and turns-on the driving transistor DT by the use of stored voltage.

The light emitting device OLED is electrically connected between a cathode source VSS and the source terminal of the driving transistor DT. The light emitting device OLED emits light due to the data current Ioled supplied from the driving transistor DT.

Accordingly, in the related art, as the driving transistor DT is switched by the data voltage Vdata, a level of the data current Ioled flowing from the driving power source VDD to the light emitting device OLED is controlled in each pixel of the organic light emitting display device and consequently the light emitting device OLED emits light, thereby displaying a predetermined image.

However, in the case of an organic light emitting display device according to the related art, the characteristics of the driving transistor DT (for example, threshold voltage Vth/mobility) may be different for each pixel due to non-uniformity in the process of manufacturing the thin film transistors used. Accordingly, even though the data voltage Vdata is identically applied to each pixel of the organic light emitting display device according to the related art, it is difficult to realize uniform picture quality due to a deviation of the current flowing in the light emitting device OLEDs.

SUMMARY

Accordingly, the present invention is directed to an organic light emitting display device and a method for operating the same that substantially obviates one or more problems due to the limitations and disadvantages of the related art.

An aspect of the present invention is to provide an organic light emitting display device and a method for operating the same, which is capable of compensating for variations in the characteristics of the driving transistors.

Another aspect of the present invention is to provide an organic light emitting display device and a method for operating the same, in which a user can not perceive a change of uniformity in a displayed image due to a compensation for variations in the characteristics of the driving transistors.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an organic light emitting display device that may include a display panel including a plurality of pixels, wherein each pixel has a driving transistor for operating a light emitting device so as to make the light emitting device emit light with a data current corresponding to a data voltage; a panel driver for detecting the characteristics of a driving transistor included in a pixel, including at least one of mobility and threshold voltage of the driving transistor during a time period when there exists no user around the display panel, compensating for input data according to the detection result after the detection for the characteristics of the driving transistor is completed to produce compensated input data, and generating the data voltage through the use of the compensated input data; and a sensor for sensing whether or not there exists a user around the display panel, and supplying the sensing result to the panel driver.

Another aspect of embodiments of the present invention is to provide a method of operating an organic light emitting display device that may include detecting the characteristics of a driving transistor included in a pixel, including at least one of mobility and threshold voltage of the driving transistor during a time period when there exists no user around a display panel; generating a data voltage by compensating for input data according to the detection result after the detection for the characteristics of the driving transistor is completed; and supplying a data current corresponding to the data voltage to a light emitting device included in the display panel so as to make the light emitting device emit light.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

In the explanation of embodiments of the present invention that follows, the following details regarding the terminology used should be understood.

The term of a singular expression should be understood to include a multiple expression as well as the singular expression if there is no specific definition in the context. In using a term such as "the first" or "the second", the intent is to separate any one element from other elements. Thus, the scope of claims is not limited by these terms.

Also, it should be understood that terms such as "include" or "have" do not preclude the existence or possibility of one or more features, numbers, steps, operations, elements, parts or their combinations.

It should be understood that the term "at least one" includes all combinations related with any one item. For example, "at least one among a first element, a second element, and a third element" may include all combinations of two or more elements selected from the first, second, and third elements as well as each element of the first, second, and third elements individually.

Hereinafter, embodiments of the present invention will be described in detail with reference to the accompanying drawings.

Figure 1:
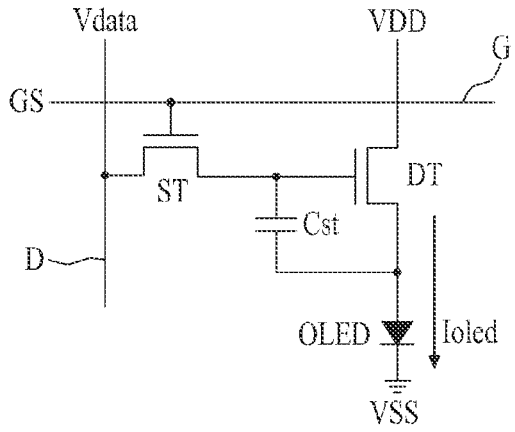
FIG. 1 [ Related Art ]
FIG. 1 is a circuit diagram showing a pixel structure of an organic light emitting display device according to the related art.
Figure 2:
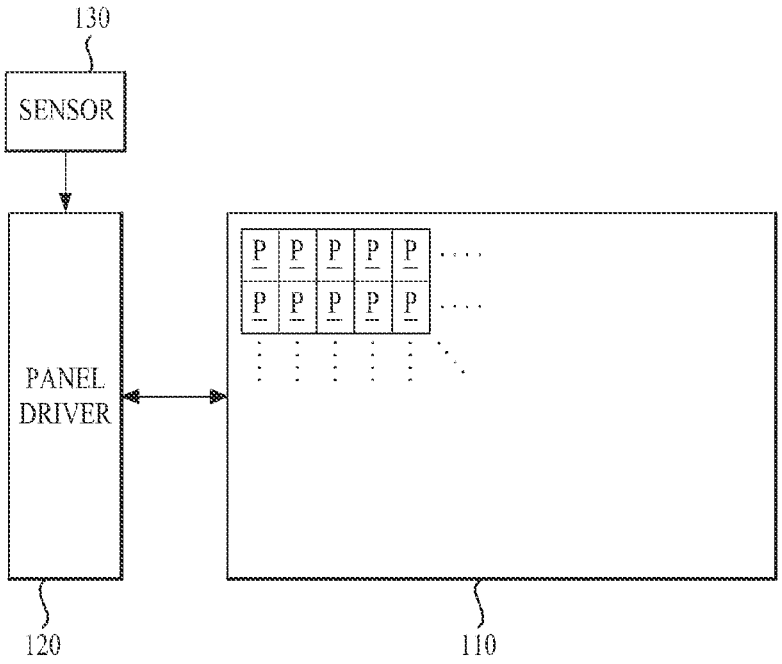
FIG. 2 illustrates an organic light emitting display device according to one embodiment.

FIG. 2 illustrates an organic light emitting display device according to one embodiment of the present invention.

Referring to FIG. 2, the organic light emitting display device according to one embodiment of the present invention includes a display panel 110, a panel driver 120, and a sensor 130.

The display panel 110 includes a plurality of pixels P. Each pixel includes a light emitting device therein, wherein the light emitting device included in each pixel P emits light by a data current which is output from a driving transistor DT included in each pixel P.

The panel driver 120 drives the display panel 110 in a display mode or a detection mode. In this case, the display mode corresponds to a mode for displaying a predetermined image by making the light emitting device, which is included in each pixel P, emit light according to input data. Meanwhile, the detection mode corresponds to a mode for detecting the characteristics of the driving transistor DT included in a pixel, including at least one of mobility and threshold voltage of the driving transistor DT (hereinafter, referred to as 'the characteristics of driving transistor DT').

The panel driver 120 reflects the characteristics of the driving transistor DT, which is detected in the detection mode, on the input data, to compensate for the variation in the characteristics of the driving transistor DT. In the following display mode, the light emitting device included in each pixel P emits light according to the input data on which the variation in the characteristics of the corresponding driving transistor DT is reflected.

In one embodiment, the panel driver 120 detects the characteristics of the driving transistor DT included in each pixel P only during a time period when there exists no user around the display panel 110. That is, the panel driver 120 drives the display panel 110 in the detection mode only during a time period when there exists no user around the display panel 110, and the panel driver 120 drives the display panel 110 in the display mode during a time period when there does exist a user around the display panel 110.

According to this embodiment of the present invention, after completing the detection for the characteristics of the driving transistor DT for all of the pixels P included in the display panel 110, the panel driver 120 compensates for the input data according to the detection result, converts the compensated input data into a data voltage, and applies the data voltage to the display panel 110.

When the panel driver 120 detects the characteristics of the driving transistors DT during a time period when there exists no user around the display panel 110, the panel driver 120 detects the characteristics of the driving transistor DT for the pixel P included in one horizontal line among a plurality of horizontal lines included in the display panel 110 every blank period, and thus detects the characteristics of the driving transistor DT for all of the pixels P included in the display panel 110 through the blank period in a plurality of frames.

According to one embodiment of the present invention, the panel driver 120 may determine a detection order in which to detect the characteristics of a horizontal line of the driving transistors DT according to a frequency component and luminance of the pixels P included in each horizontal line, and may sequentially detect the characteristics of the driving transistor DT for the pixel P included in each horizontal line according to the detection order during a time period when there exists no user around the display panel 110.

For example, the panel driver 120 may arrange the respective horizontal lines in order of average luminance of the pixels P included in each horizontal line, and may determine the detection order in order of average luminance of the pixels P included in each horizontal line, that is, the sequential order from the horizontal line with the highest average luminance to the horizontal line with the lowest average luminance.

According to another example, when the luminance values of the pixels P included in each horizontal line are converted into the frequency components, the panel driver 120 may determine the highest frequency component as a representative frequency value for each horizontal line, and may sequentially determine the detection order to be from the horizontal line with the highest representative frequency value to the horizontal line with the lowest representative frequency value.

The sensor 130 senses whether or not there exists a user around the display panel 110 by the use of one or more sensors, and transmits the sensing result to the panel driver 120. According to one embodiment of the present invention, the sensor 130 senses whether or not there exists a user around the display panel 110 by the use of at least one of a thermal sensor, an infrared sensor, and a photo sensor.

If the sensor 130 is a thermal sensor, it is determined whether or not there exists a user around the display panel 110 through a temperature change sensed by the thermal sensor.

Figure 3:
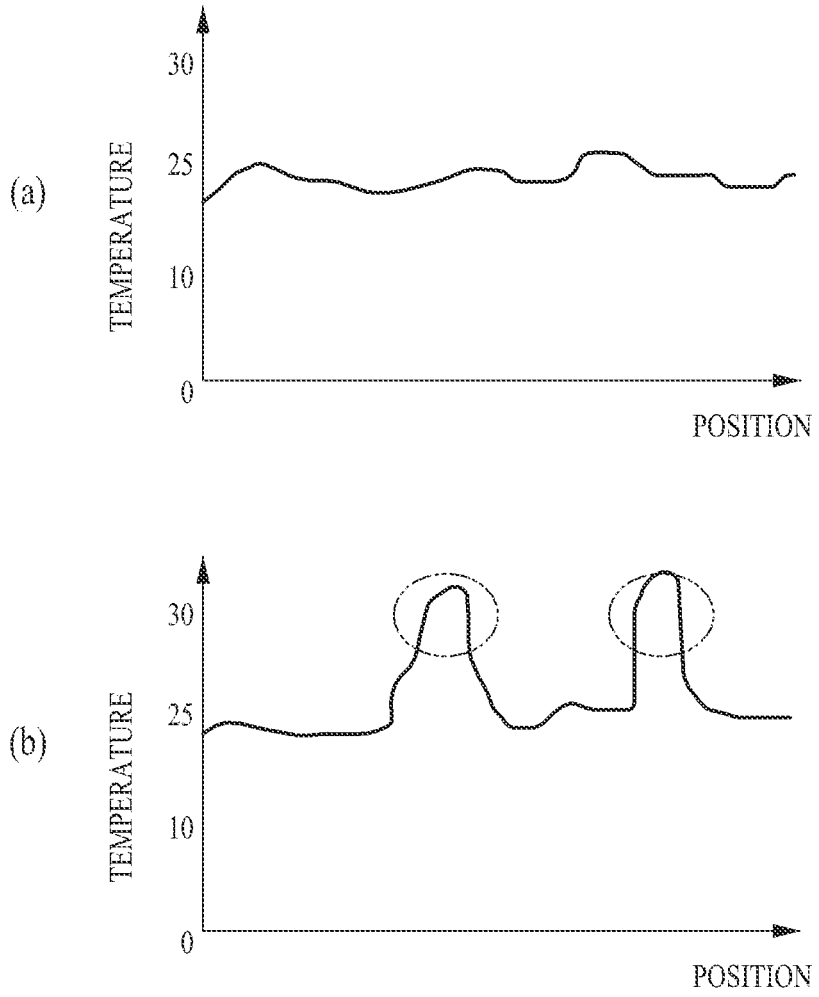
FIGS. 3A and 3B illustrate a method of sensing whether or not there exists a user around a display panel through the use of thermal sensor, according to one embodiment.

For example, as shown in FIG. 3A, if there is no temperature change, it is determined that there exists no user around the display panel 110. In contrast, as shown in FIG. 3B, if there is a temperature change, it is determined that there exists a user around the display panel 110, and then the sensing result is transmitted to the panel driver 120.

If the sensor 130 is a photo sensor, whether or not there exists a user around the display panel 110 is determined by comparing an Nth image and an (N−1)th image taken by the use of photo sensor with each other.

Figure 4A:
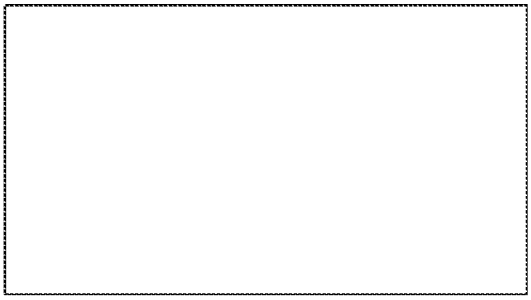
FIGS. 4A, 4B, and 4C illustrate a method of sensing whether or not there exists a user around a display panel through the use of photo sensor, according to one embodiment.
Figure 4B:
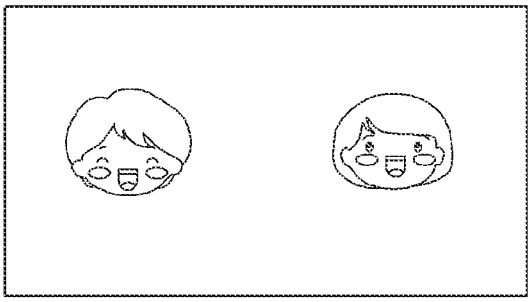
Figure 4C:
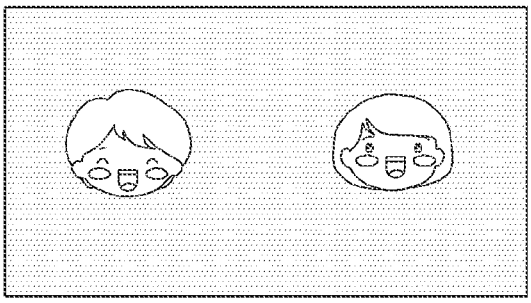

For example, the sensor 130 produces a differential image, shown in FIG. 4C, between the (N−1)th image shown in FIG. 4A and the Nth image shown in FIG. 4B, and then checks whether or not there is a user's movement or flicker, so that it is possible to determine whether or not there exists a user around the display panel 110.

Although not shown, if the sensor 130 is an infrared sensor, an intensity of signal, which is produced in a light-emitting part included in the infrared sensor and is then received in a light-receiving part, is not more than a predetermined value, it is determined that there exists no user around the display panel 110. In contrast, if the intensity of signal received in the light-receiving part is more than the predetermined value, it is determined that there exists a user around the display panel 110.

In the case of the infrared sensor, when there exists an object in front of the infrared sensor, the signal produced in the light-emitting part is reflected by the object, and is then received in the light-receiving part, and thus the intensity of the signal is strong. In contrast, when there exists no object in front of the infrared sensor, the signal produced in the light-emitting part is typically reflected from a surface opposite to the sensor, and is then received in the light-receiving part, and thus the intensity of the signal is weak. If there is no opposite surface, the signal is not received in the light-receiving part. Based on the above principle, it is possible to determine whether or not there exists a user around the display panel 110 by the use of the infrared sensor.

Figure 5A:
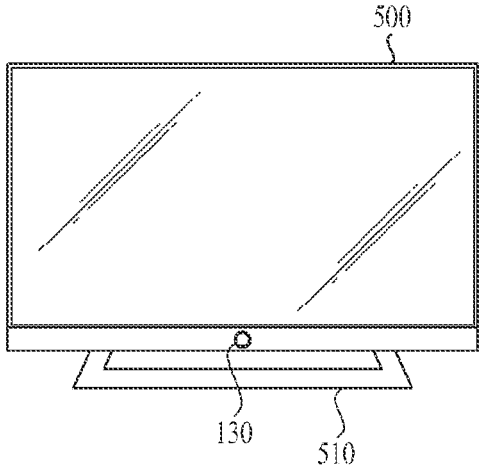
FIGS. 5A to 5D illustrate examples of a position of a sensor for detecting whether or not there exists a user around a display panel, according to one embodiment.
Figure 5B:
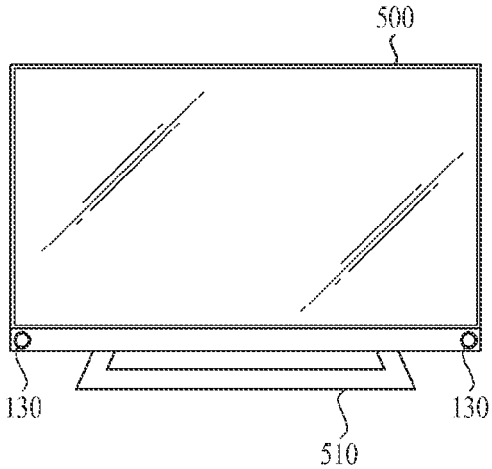
Figure 5C:
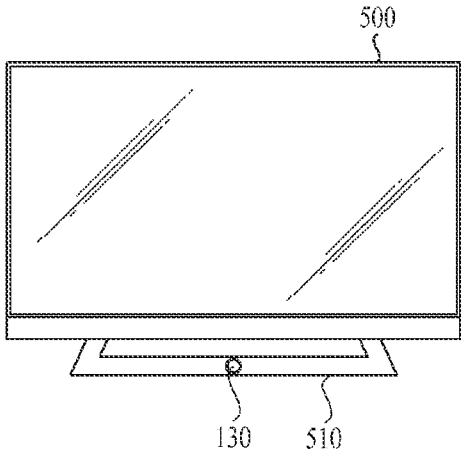
Figure 5D:
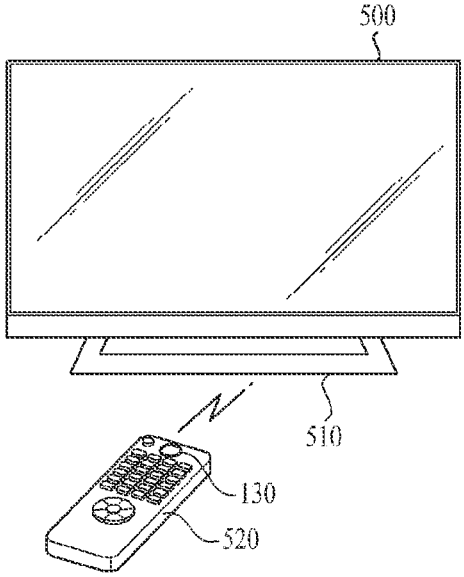

The sensor 130 may be provided in various positions with respect to the organic light emitting display device. For example, the sensor 130 may be provided at a lower side of the organic light emitting display device 500 as shown in FIG. 5A, provided at a right or left side of the organic light emitting display device 500 as shown in FIG. 5B, or provided at a holder 510 of the organic light emitting display device 500 as shown in FIG. 5C.

According to another example, the sensor 130 may be provided in a remote controller 520 for operating the organic light emitting display device 500 from a short distance. In this case, the sensor 130 wirelessly transmits the sensing result to the panel driver 120.

According to the above description of the present invention, whether or not there exists a user around the display panel 110 is sensed by the use of sensor 130; the panel driver 120 drives the display panel 110 in the detection mode only during a time period when there exists no user around the display panel 110; and the detection for the characteristics of the driving transistors DT included in the pixels P is completed and is then reflected on the input data. The pixel P is then driven based on the input data, so that it is possible to improve satisfaction with picture quality because a user can not perceive non-uniformity of displayed image, as compensation for the driving transistor characteristics was reflected on the input data while there existed no user around the display panel 110.

Hereinafter, a structure of an embodiment of the organic light emitting display device with the above-described characteristics will be described in detail with reference to FIGS. 6 to 11.

Figure 6:
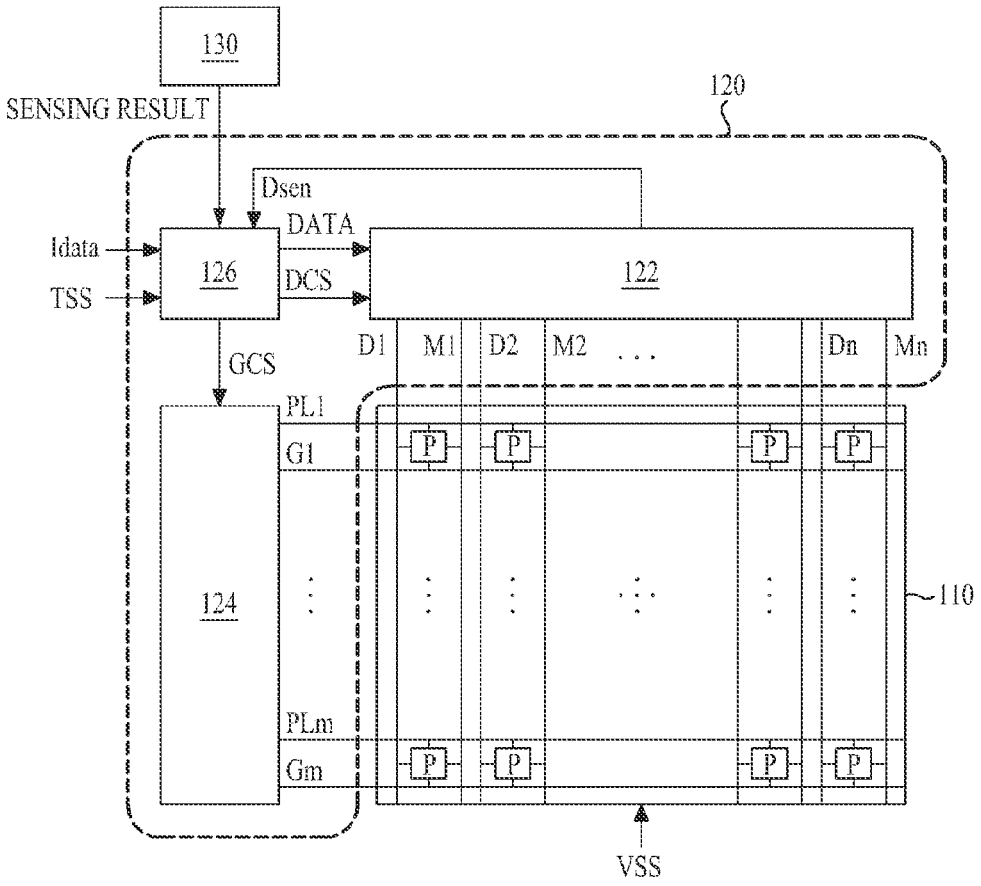
FIG. 6 illustrates a structure of the organic light emitting display device according to one embodiment of the present invention.
Figure 7:
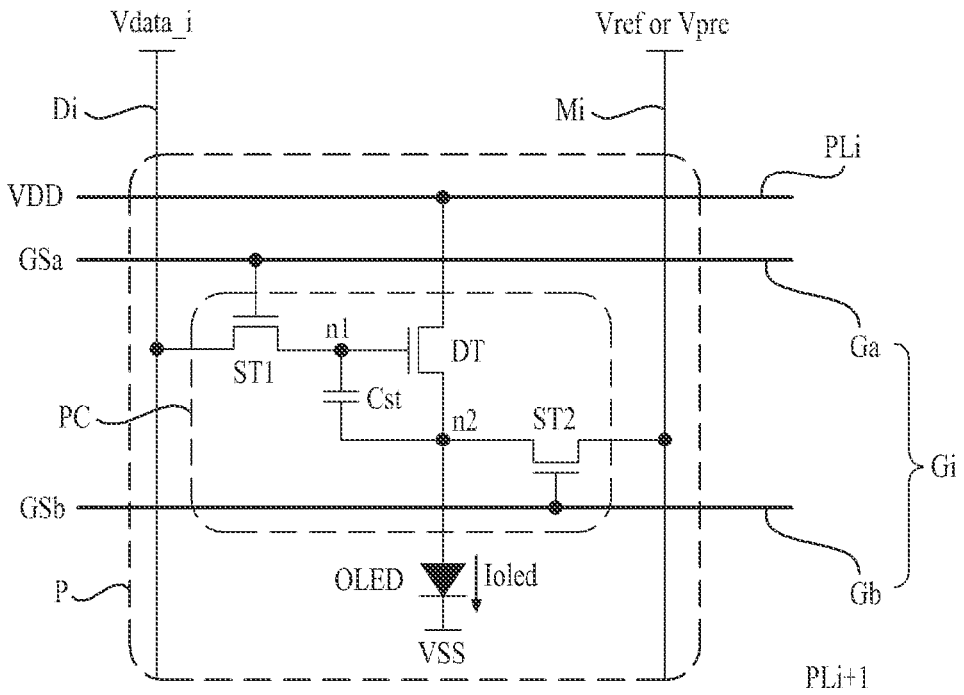
FIG. 7 is a circuit diagram showing an exemplary structure for the pixels shown in FIG. 6.

FIG. 6 illustrates a structure of the organic light emitting display device according to one embodiment of the present invention. FIG. 7 is a circuit diagram showing an exemplary structure for the pixels shown in FIG. 6.

A display panel 110 includes a plurality of pixels P. Each of the pixels P is formed in a pixel region that is defined by a plurality of gate line groups G1 to Gm, a plurality of data lines D1 to Dn, a plurality of detections lines M1 to Mn, and a plurality of driving power lines PL1 to PLm, wherein the gate line groups G1 to Gm cross the data lines D1 to Dn, the detection lines M1 to Mn are parallel to the data lines D1 to Dn, and the driving power lines PL1 to PLm are parallel to the gate line groups G1 to Gm.

Each of the pixels P include a pixel circuit PC and a light emitting device OLED. Each of pixels P may be any one among red, green, blue and white pixels. A unit pixel for displaying an image may include adjacent red, green and blue pixels, or may include adjacent red, green, blue and white pixels.

According to one embodiment of the present invention, the pixel circuit PC includes a first switching transistor ST1, a second switching transistor ST2, a driving transistor DT, and a capacitor Cst. In this case, the transistors ST1, ST2 and DT are N-type thin film transistors TFT, for example, a-Si TFT, poly-Si TFT, oxide TFT, organic TFT, and etc. In other embodiments, other types of transistor are used.

The first switching transistor ST1 includes a gate electrode connected to a first gate line Ga, a first electrode connected to the adjacent data line Di, and a second electrode connected to a first node n1 corresponding to a gate electrode of the driving transistor DT. The first switching transistor ST1 supplies a data voltage Vdata, which is supplied to the data line Di according to a gate-on voltage supplied to the first gate line Ga, to the first node n1 corresponding to the gate electrode of the driving transistor DT.

The second switching transistor ST2 includes a gate electrode connected to a second gate line Gb, a first electrode connected to the adjacent connection line Mi, and a second electrode connected to a second node n2 corresponding to a source electrode of the driving transistor DT. The second switching transistor ST2 supplies a reference voltage Vref (or pre-charging voltage Vpre), which is supplied to the detection line Mi according to a gate-on voltage supplied to the second gate line Gb, to the second node N2 corresponding to the source electrode of the driving transistor DT.

The capacitor Cst includes first and second electrodes connected between gate and source electrodes of the driving transistor DT, that is, the first and second nodes n1 and n2. The capacitor Cst charges a differential voltage between voltages applied to the first and second nodes n1 and n2, and switches the driving transistor DT according to the charged differential voltage.

The driving transistor DT includes the gate electrode connected to the second electrode of the first switching transistor ST1 and the first electrode of the capacitor Cst in common; the source electrode connected to the first electrode of the second switching transistor ST2, the second electrode of the capacitor Cst, and the light emitting device OLED in common; and a drain electrode connected to the driving power line PLi. Accordingly, as the driving transistor DT is turned-on by the voltage of the capacitor Cst, it is possible to control an amount of current flowing from the driving power line PLi to the light emitting device OLED.

In the above embodiment of the present invention, the pixel circuit PC includes the three transistors and one capacitor. However, the number of transistors and capacitors constituting the pixel circuit PC may be changed.

The light emitting device OLED is operated by a data current Ioled supplied from the pixel circuit PC, that is, the driving transistor DT, to thereby emit monochromatic light with a luminance corresponding to the data current Ioled. To this end, the light emitting device OLED may include an anode electrode (not shown) connected to the second node n2 of the pixel circuit PC, an organic layer (not shown) formed on the anode electrode, and a cathode electrode (not shown) supplied with a cathode power source VSS and formed on the organic layer. In this case, the organic layer is formed in a deposition structure of a hole transport layer/an organic light emitting layer/an electron transport layer or a deposition structure of a hole injection layer/a hole transport layer/an organic light emitting layer/an electron transport layer/an electron injection layer. Furthermore, the organic layer may include a functional layer for improving light-emitting efficiency and/or lifespan of the organic light emitting layer. Also, the cathode electrode may be individually formed in each of the pixels P, or may be connected to the plurality of pixels P in common.

The plurality of gate line groups G1 to Gm are formed in a first direction of the display panel 110, for example, a horizontal direction of the display panel 110. Each of the gate lines groups G1 to Gm may comprise the neighboring first and second gate lines Ga and Gb. The first and second gate lines Ga and Gb included in each of the gate line groups G1 to Gm may be respectively supplied with different first and second gate signals provided from the panel driver 120.

The plurality of data lines D1 to Dm are formed in a second direction of the display panel, for example, a vertical direction of the display panel, wherein the plurality of data lines D1 to Dm are provided to respectively cross the plurality of gate lines groups G1 to Gm. Each of the data lines D1 to Dn may be individually supplied with the data voltage Vdata provided from the panel driver 120.

According to one embodiment of the present invention, the data voltage Vdata supplied to each pixel P through the plurality of data lines D1 to Dn is the data voltage, for which the variation in the characteristics of the driving transistor DT included in the corresponding pixel P is compensated. In this case, the characteristics of the driving transistor DT include at least one of a threshold voltage of the driving transistor DT and a mobility of the driving transistor DT.

The plurality of detection lines M1 to Mn are respectively parallel to the plurality of data lines D1 to Dn. The respective detection lines M1 to Mn may be selectively supplied with the reference voltage Vref or pre-charging voltage Vpre provided from the panel driver 120. In this case, the reference voltage Vref is supplied to each detection line during a data charging period in each pixel P, and the pre-charging voltage Vpre is supplied to the detection line M1 to Mn during a predetermined period of a detection time for detecting the characteristics of the driving transistor DT in each pixel P.

The respective driving power lines PL1 to PLm are parallel to the respective gate lines groups G1 to Gm. Each of the driving power lines PL1 to PLm may be supplied with a driving power source VDD having a predetermined voltage level provided from the panel driver 120.

In one embodiment, the panel driver 120 includes a column driver 122, a row driver 124, and a timing controller 126.

The column driver 122 is connected to the plurality of data lines D1 to Dn, and the column driver 122 is driven in a display mode or a detection mode according to a mode control of the timing controller 126. For the display mode, each pixel P is driven for a data charging period and a light emitting period. For the detection mode, each pixel P is driven for an initialization period, a detection voltage charging period, and a voltage detection period.

In the display mode, the column driver 122 supplies the reference voltage Vref to the detection line M1 to Mn during every data charging period in each pixel P; and simultaneously converts pixel data DATA supplied from the timing controller 126 into a data voltage Vdata, and then supplies the data voltage Vdata to the corresponding data line D1 to Dn.

In the detection mode, the column driver 122 supplies the pre-charging voltage Vpre to the detection line M1 to Mn during every additional detection period; and simultaneously converts detection pixel data DATA supplied from the timing controller 126 into a detection data voltage Vdata, and then supplies the detection data voltage Vdata to the corresponding data line D1 to Dn. Then, the column driver 122 makes each detection line M1 to Mn floating so as to charge each detection line M1 to Mn with the voltage corresponding to the current flowing in the driving transistor DT for each pixel P by the pre-charging voltage Vpre and the detection data voltage Vdata. Thereafter, the column driver 122 detects the voltage charged in each detection line M1 to Mn, converts the detected voltage into detection data Dsen corresponding to the characteristics of driving transistor DT (at least one of threshold voltage and mobility) for each pixel P, and provides the detection data Dsen to the timing controller 126.

The row driver 124 is connected to the plurality of gate line groups G1 to Gm, and the row driver 124 is driven in a display mode or a detection mode according to a mode control of the timing controller 126.

In the display mode, the row driver 124 generates first and second gate signals GSa and GSb of gate-on voltage level every one horizontal period according to a gate control signal GCS supplied from the timing controller 126, and sequentially supplies the generated first and second gate signals GSa and GSb to the gate line groups G1 to Gm. In this case, while each of the first and second gate signals GSa and GSb is maintained in the gate-on voltage level during the data charging period, each of the first and second gate signals GSa and GSb is maintained in a gate-off voltage level during the light emitting period. The row driver 124 may be a shift register which sequentially outputs the first and second gate signals GSa and GSb to be respectively supplied to the gate line groups G1 to Gm according to the gate control signal GCS.

The row driver 124 may generate the first and second gate signals GSa and GSb with different ranges of gate-on voltage level, and may overlap the first and second gate signals GSa and GSb of the gate-on voltage level, respectively supplied to the adjacent gate line groups G1 to Gm, with each other during at least one horizontal period.

In the detection mode, the row driver 124 generates first and second gate signals GSa and GSb of gate-on voltage level every initialization period and detection voltage charging period in each pixel P, and respectively supplies the first and second gate signals GSa and GSb to the plurality of gate line groups G1 to Gm. Also, the row driver 124 generates a first gate signal GSa of gate-off voltage level and a second gate signal GSb of gate-on voltage level every voltage detection period in each pixel P, and respectively supplies the first and second gate signals GSa and GSb to the plurality of gate line groups G1 to Gm.

In one embodiment, the row driver 124 is formed in an integrated circuit (IC). Alternatively, the row driver 124 is directly formed on a substrate of the display panel 110 during a process of manufacturing the transistor for each pixel P, and connected to one side in each of the first to mth gate line groups G1 to Gm.

The row driver 124 is respectively connected to the plurality of driving power lines PL1 to PLm, and the row driver 124 transmits a driving power supplied from an externally-provided power supplier (not shown) to the plurality of driving power lines PL1 to PLm.

The timing controller 126 operates the column driver 122 and the row driver 124 in the display mode, and determines whether to detect the characteristics of driving transistor DT on the basis of sensing a result transmitted from the sensor 130, and operates the column driver 122 and the row driver 124 in the detection mode when the detection for the characteristics of the driving transistor DT is determined.

According to one embodiment of the present invention, the timing controller 126 detects the characteristics of the driving transistors DT only during a time period when it is determined that there exists no user around the display panel 110 by the sensor 130. In this case, the detection for the characteristics of the driving transistors DT is performed during a blank period of a frame for displaying an image on the display panel 110. In more detail, the timing controller 126 detects the characteristics of the driving transistor DT for each pixel P formed in one horizontal line every blank period, and thus detects the characteristics of the driving transistor DT for each of the pixels P included in the display panel 100 through the blank period of a plurality of frames.

In the above embodiment of the present invention, the timing controller 126 determines whether to detect the characteristics of the driving transistors DT according to the sensing result of the sensor 130, but other methods may be used. According to a modified example, the detection of the characteristics of the driving transistors DT is determined by a user. Alternatively, the detection of the characteristics of the driving transistors DT is performed once every predetermined cycle. For instance, the detection for the characteristics of the driving transistors DT may be performed at an initial driving point or a long-time driving end point. In this case, the timing controller 126 detects the characteristics of the driving transistor DT for each of the pixels P included in the display panel 110 during one frame of the display panel 110.

In the display mode, the timing controller 126 generates a data control signal DCS and a gate control signal GCS to drive each pixel P connected to each of the gate line groups G1 to Gm for the data charging period and the light emitting period once every horizontal period of the basis of timing synchronous signal TSS input from an external source (e.g., the system body (not shown) or a graphics card (not shown)); and controls the column driver 122 and the row driver 124 so as to make the column driver 122 and the row driver 124 be driven in the display mode.

In the display mode, the timing controller 126 generates pixel data DATA by compensating for the input data Idata, which is input from the external source on the basis of detection data Dsen for each pixel P provided from the column driver 122 in the detection mode of the timing controller 126, and then supplies the generated pixel data DATA to the column driver 122. In this case, the pixel data DATA to be supplied to each pixel P has a grayscale value obtained by reflecting the detection data Dsen corresponding to the variation in the characteristics of driving transistor DT for each pixel P on the input data Idata.

The input data Idata may comprise red, green and blue input data to be supplied to one unit pixel. If the unit pixel includes red pixel, green pixel and blue pixel, the pixel data D may be red, green or blue data. Meanwhile, if the unit pixel includes red pixel, green pixel, blue pixel and white pixel, the pixel data DATA may be red, green, blue or white data.

In the detection mode, the timing controller 126 generates a data control signal DCS and a gate control signal GCS to detect the characteristics of the driving transistor DT for each pixel P connected to the gate line group G1 to Gm corresponding to the horizontal line to be detected on the basis of the detection order of the respective horizontal lines, and then controls the column driver 122 and the row driver 124 so as to make the column driver 122 and the row driver 124 driven in the detection mode based on the generated data control signal DCS and the gate control signal GCS.

The timing synchronous signal TSS may be a vertical synchronous signal Vsync, horizontal synchronous signal Hsync, data enable DE, clock DCLK, etc. The gate control signal GCS may comprise a gate start signal and a plurality of clock signals. The data control signal DCS may comprise a data start signal, a data shift signal and a data output signal.

In the detection mode, the timing controller 126 generates predetermined detection data, and supplies the generated detection data to the column driver 122.

FIG. 2 shows that the column driver 122 is connected to one side in each of the plurality of data lines D1 to Dn, but the claims should not be limited to this structure. For example, in order to minimize a voltage drop of the data voltage Vdata, the column driver 122 may be connected to both sides in each of the plurality of data lines D1 to Dn. In a similar manner, the row driver 124 may be connected to both ends in each of the plurality of gate line groups G1 to and Gm and the plurality of driving power lines PL1 to PLm in order to minimize a voltage drop of the gate signal and a voltage drop of the driving power source VDD.

Figure 8:
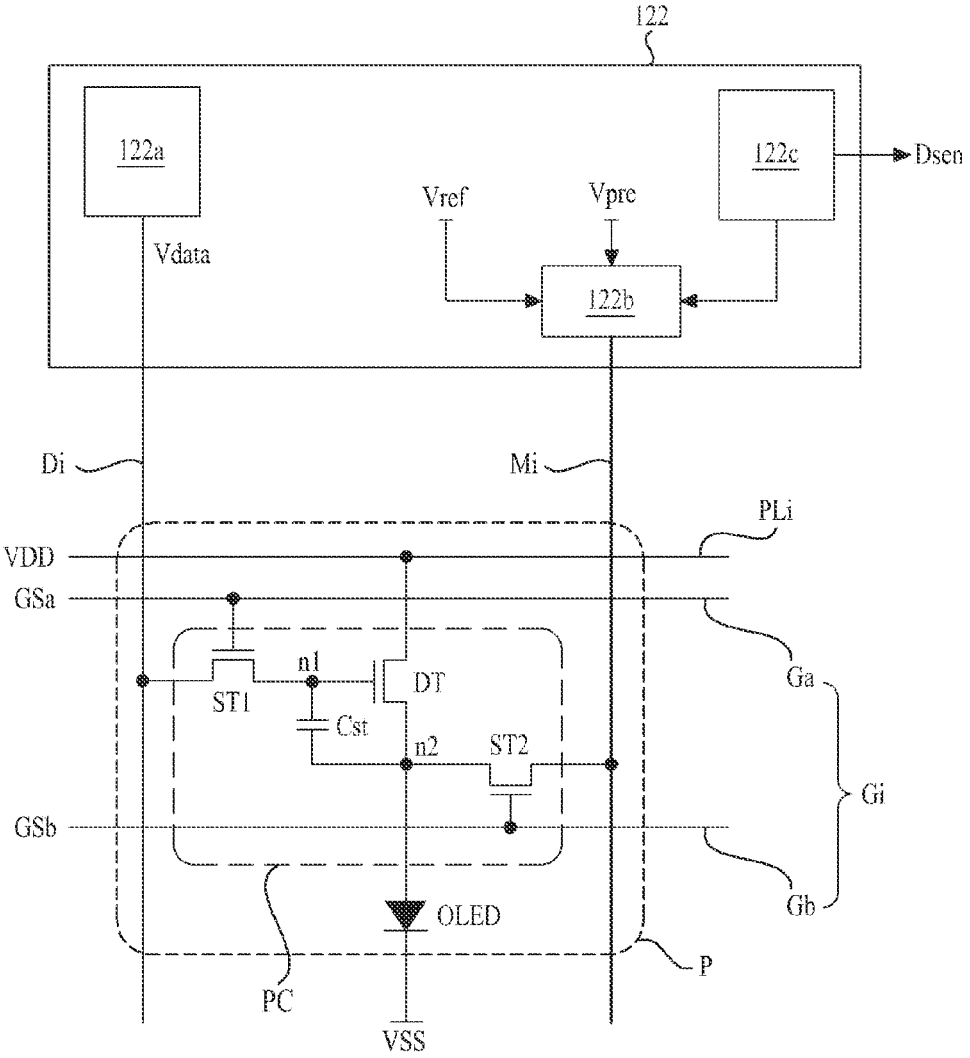
FIG. 8 illustrates an embodiment of the column driver shown in FIG. 6.

FIG. 8 illustrates the detailed structure of one embodiment of the column driver 122 shown in FIG. 6. In the embodiment shown in FIG. 8, the column driver 122 includes a data voltage generator 122*a*, a switch 122*b*, and a detection data generator 122*c*. For convenience of explanation, the column driver 122 will be described with reference to FIGS. 6 and 8.

When the data control signal DCS of the display mode is input to the data voltage generator 122*a*, the data voltage generator 122*a* converts correction data DATA supplied from the timing controller 126 into the data voltage Vdata, and supplies the data voltage Vdata to the data line Di. Also, when the data control signal DCS of the detection mode is input to the data voltage generator 122*a*, the data voltage generator 122*a* converts detection pixel data DATA supplied from the timing controller 126 into the detection data voltage Vdata, and supplies the detection data voltage Vdata to the data line Di.

To this end, the data voltage generator 122*a* may include a shift register for generating a sampling signal; a latch for latching the data DATA input according to the sampling signal; a grayscale voltage generator for generating a plurality of grayscale voltages by the use of reference gamma voltages; a digital-analog converter for selecting the grayscale voltage corresponding to the latched data DATA among the plurality of grayscale voltages, and outputting the selected grayscale voltage as the data voltage Vdata; and an output for outputting the data voltage Vdata.

The switch 122*b* supplies the reference voltage Vref to the detection line Mi under the control of the timing controller 126 according to the display mode. Also, the switch 122*b* supplies the pre-charging voltage Vpre to the detection line Mi under the control of the timing controller 126 according to the detection mode; makes the detection line Mi floating; and then connects the detection line Mi to the detection data generator 122*c*. For example, the switch 122*b* may be a di-multiplexer.

When the detection data generator 122*c* is connected to the detection line Mi by the switching operation of the switch 122 in the detection mode, the detection data generator 122*c* detects the voltage charged in the detection line Mi, generates the detection data Dsen of digital type corresponding to the detected voltage Vsen, and provides the generated detection data Dsen to the timing controller 126.

Figure 9:
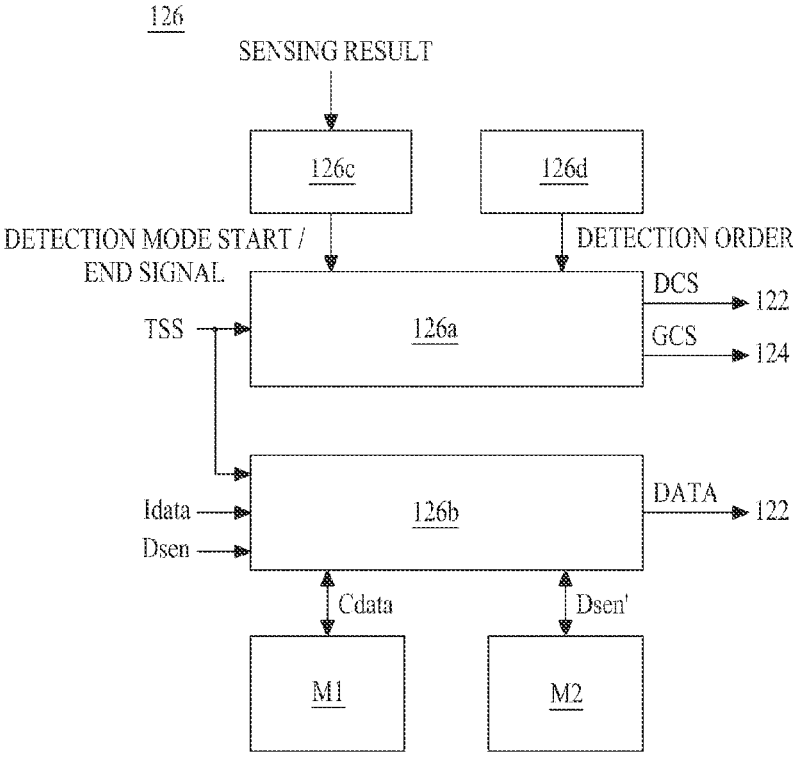
FIG. 9 illustrates an embodiment of the timing controller shown in FIG. 6.

FIG. 9 illustrates the detailed structure of one embodiment of the timing controller 126 shown in FIG. 6. In the embodiment shown in FIG. 9, the timing controller 126 includes a control signal generator 126*a*, first and second storing parts M1 and M2, a data processor 126*b*, a detection mode determining part 126*c*, and a scheduling part 126*d*. For convenience of explanation, the timing controller 126 will be described with reference to FIGS. 6 and 9.

The control signal generator 126*a* generates the data control signal DCS and the gate control signal GCS corresponding to the display mode or the detection mode on the basis of the timing synchronous signal TSS input from the external source; and supplies the data control signal DCS to the column driver 122, and simultaneously supplies the gate control signal GCS to the row driver 124.

When a detection mode start signal is transmitted from the detection mode determining part 126*c* to the control signal generator 126*a*, the control signal generator 126*a* generates the data control signal DCS and the gate control signal GCS corresponding to the detection mode on the basis of the timing synchronous signal TSS. When a detection mode end signal is transmitted to the control signal generator 126*a*, the control signal generator 126*a* generates the data control signal DCS and the gate control signal GCS corresponding to the display mode on the basis of the timing synchronous signal TSS.

In this case, the control signal generator 126*a* generates the gate control signal GCS on the basis of the detection order of the respective horizontal lines, wherein the detection order is determined by the scheduling part 126*d* when the gate control signal GCS corresponding to the detection mode is generated, so that it is enabled to detect only the characteristics of the driving transistors DT for the pixels P included in the corresponding horizontal line to be detected.

In the first storing part Ml, compensation data Cdata for each of the pixels P included in the display panel 110 is mapped to correspond with the pixel arrangement structure. The compensation data Cdata is generated by an optical luminance measuring method with the use of an optical luminance measuring apparatus. In one embodiment, the luminance for each pixel P is measured by displaying an identical test pattern in each of the pixels P of the display panel 110, and a compensation value is set to compensate for a deviation between the measured luminance value for each pixel P and a reference luminance value of the test pattern, and this compensation value is used as the compensation data Cdata for the corresponding pixel. Preferably, the compensation data Cdata stored in the first storing part M1 is not updated.

In the second storing part M2, initial detection data Dsen' for each pixel P, which is detected by the column driver 122 according to the detection mode, is mapped to correspond with the pixel arrangement structure. In one embodiment, the initial detection data Dsen' is a voltage value corresponding to the characteristics of the driving transistors DT for all the pixels P included in the display panel 110, which is detected all through the above performance of the detection mode at a shipping time (or initial driving time) of the display panel 110.

The data processor 126*b* compares the detection data Dsen for each pixel P provided from the column driver 122 in the detection mode with initial detection data Dsen' for each pixel P stored in the second storing part M2. Based on the comparing result, if a deviation is within a reference deviation range, the data processor 126*b* generates the correction data DATA by correcting the input data Idata input from the external source on the basis of the compensation data Cdata for each pixel P stored in the first storing part Ml, and supplies the generated correction data DATA to the column driver 122.

In contrast, if the deviation between the detection data Dsen for each pixel P and the initial detection data Dsen' is above the reference deviation range, the data processor 126*b* generates the correction data DATA by correcting the input data Idata on the basis of the compensation data Cdata for each pixel P and the deviation between the detection data Dsen for each pixel P and the initial detection data Dsen', and supplies the generated correction data DATA to the column driver 122.

The data processor 126*b* determines the compensation value by presuming a current variation according to the variation in the characteristics of the driving transistor DT for each pixel P on the basis of the detection data Dsen, and generates the correction data DATA by correcting the input data Idata according to the compensation value. Thus, the light emitting device OLED for each pixel P emits light with the luminance corresponding to the initial input data Idata by the data voltage with the compensated characteristic variation of the driving transistor DT according to the correction data DATA.

The detection mode determining part 126*c* determines the start or end of the detection mode according to the sensing result transmitted from the sensor 130; and generates the start or end signal of the detection mode, and transmits the generated start or end signal of the detection mode to the control signal generator 126*a*.

According to one embodiment of the present invention, the detection mode determining part 126*c* determines the start of the detection mode when it is determined that there exists no user around the display panel 110 by the sensor 130, generates the start signal of the detection mode, and transmits the generated start signal to the control signal generator 126*a*.

Then, when it is determined that there exists a user around the display panel 110 by the use of the sensor 130, the detection mode determining part 126*c* generates the end signal of the detection mode, and transmits the generated end signal to the control signal generator 126*a*.

In this case, the start signal of the detection mode is a pulse signal with a high level, and the end signal of the detection mode is a pulse signal with a low level. Other signals may be used for the start and end signals.

The scheduling part 126*d* determines the detection order for detecting the characteristics of the horizontal lines of driving transistors DT included in the display panel 110 during the performance of the detection mode. According to one embodiment of the present invention, the scheduling part 126*d* determines the detection order for detecting the characteristics of the horizontal lines of driving transistors DT according to the frequency component and luminance of the pixels P included in each of the horizontal lines of the display panel 110.

For example, the scheduling part 126*d* arranges the respective horizontal lines in order of average luminance of the pixels P included in each horizontal line, and determines the detection order in order of average luminance of the pixels P included in each horizontal line, that is, the sequential order from the horizontal line with the highest average luminance to the horizontal line with the lowest average luminance.

According to another example, when the luminance values of the pixels P included in each horizontal line are converted into the frequency components, the scheduling part 126*d* determines the highest frequency component as a representative frequency value for each horizontal line, and sequentially determines the detection order from the horizontal line with the highest representative frequency value to the horizontal line with the lowest representative frequency value.

The scheduling part 126*d* transmits the determined detection order to the control signal generator 126*a*, thereby enabling the control signal generator 126*a* to generate the gate control signal GCS according to the determined detection order.

Referring once again to FIG. 6, the sensor 130 senses whether or not there exists a user around the display panel 110 by the use of various sensors, and transmits the sensing result to the panel driver 120. According to one embodiment of the present invention, the sensor 130 senses whether or not there exists a user around the display panel 110 by the use of at least one of a thermal sensor, an infrared sensor, and a photo sensor.

Hereinafter, respective operations of the organic light emitting display device according to the display mode and the detection mode will be described in brief with reference to FIGS. 10 and 11.

Figure 10:
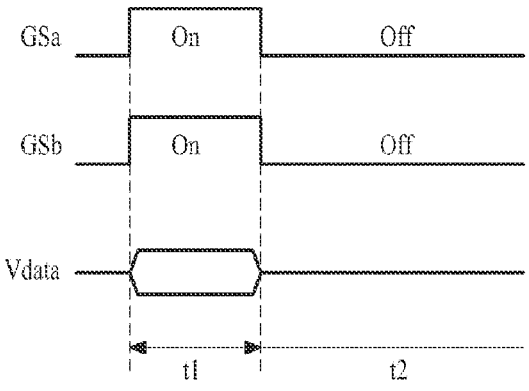
FIG. 10 is a waveform diagram illustrating driving waveforms of a display mode in the organic light emitting display device according to one embodiment.

FIG. 10 is a waveform diagram illustrating driving waveforms of the display mode in the aforementioned organic light emitting display device. The operation of the display mode for one pixel P shown in FIG. 8 will be described with reference to FIG. 10 in connection with FIGS. 6 and 8.

First, the timing controller 126 generates the correction data DATA by correcting the input data Idata on the basis of the detection data Dsen for each pixel P provided from the column driver 122. Then, the timing controller 126 controls the driving timing for each of the column driver 122 and the row driver 124, whereby each pixel P is driven for the data charging period t1 and light emitting period t2.

During the data charging period t1, the first and second gate signals GSa and GSb of gate-on voltage level are respectively supplied to the first and second gate lines Ga and Gb by the aforementioned row driver 124; and the data voltage Vdata converted from the correction data DATA is supplied to the data line Di by the aforementioned column driver 122, and the reference voltage Vref is supplied to the detection line Mi by the aforementioned column driver 122.

Accordingly, the first and second switching transistors ST1 and ST2 for each pixel P are respectively turned-on by the first and second gate signals GSa and GSb of gate-on voltage level, whereby the data voltage Vdata is supplied to the first node n1, and the voltage of the second node n2 is initialized to the reference voltage Vref. Thus, the capacitor Cst connected to the first node n1 and the second node n2 is charged with the differential voltage Vdata-Vref between the data voltage Vdata and the reference voltage Vref.

During the light emitting period t2, the first and second gate signals GSa and GSb of gate-off voltage level are respectively supplied to the first and second gate lines Ga and Gb by the row driver 124. Accordingly, the first and second switching transistors ST1 and ST2 for each pixel P are respectively turned-off by the first and second gate signals GSa and GSb of gate-off voltage level during the light emitting period t2, whereby the driving transistor DT is turned-on by the voltage stored in the capacitor Cst.

Thus, the turned-on driving transistor DT supplies the data current Ioled, which is determined by the differential voltage Vdata-Vref between the data voltage Vdata and the reference voltage Vref, to the light emitting device OLED, whereby the light emitting device OLED emits light in proportion to the data current Ioled flowing from the driving power line OL to the cathode electrode, as shown in Equation 1, below. That is, if the first and second switching transistors ST1 and ST2 are turned-off during the light emitting period t2, the current flows in the driving transistor DT, and the light emission of the light emitting device OLED is started in proportion to the current flowing in the driving transistor DT, whereby the voltage of the second node n2 is raised. Thus, as the voltage of the first node n1 is raised by the voltage raise of the second node n2 through the capacitor Cst, a gate-source voltage Vgs of the driving transistor DT is continuously maintained by the voltage of the capacitor Cst, whereby the light emission of the light emitting device OLED is maintained until to the next data charging period t1.

$$\text{Ioled}=k(V\text{data}-V\text{ref})^2 \qquad \text{Equation 1}$$

In Equation 1, "k" is a proportionality constant, which is determined by the structural and physical characteristics of the driving transistor DT, wherein "k" is determined by the mobility of the driving transistor DT and the ratio "W/L" where W is a channel width and L is a channel length of the driving transistor DT.

In Equation 1, in the case of the data current Ioled flowing in the light emitting device OLED during the light emitting period t2, the variation in the characteristics of driving transistor DT is not affected by the data voltage Vdata converted from the correction data DATA whose variation in the characteristics of driving transistor DT is compensated for.

Accordingly, the organic light emitting device according to one embodiment of the present invention drives the pixel P by the correction data DATA on which the detection data Dsen corresponding to the characteristics of driving transistor DT for the pixel P in the display mode is reflected, thus compensating for the deviation of the variations in the characteristics of the driving transistor DT of the pixel P, either periodically or in real-time.

Figure 11:
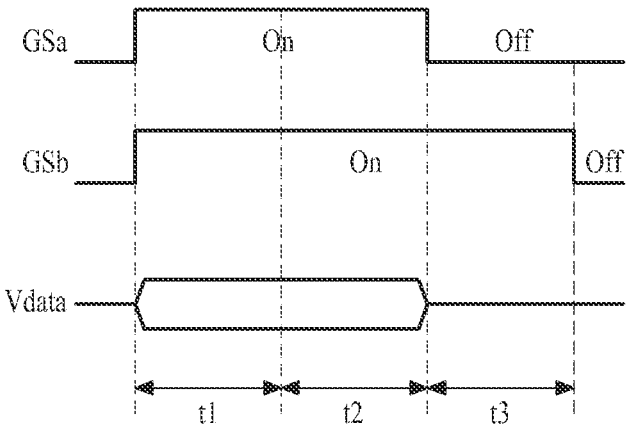
FIG. 11 is a waveform diagram illustrating driving waveforms of a detection mode in the organic light emitting display device according to one embodiment.

FIG. 11 is a waveform diagram illustrating driving waveforms of the detection mode in the aforementioned organic light emitting display device. The operation of the detection mode for one pixel P shown in FIG. 8 will be described with reference to FIG. 11 in connection with FIGS. 6 and 8.

First, when the start of the detection mode is determined based on the sensing result of the sensor 130, the aforementioned timing controller 126 controls the driving timing for each of the column driver 122 and the row driver 124, whereby each pixel P is driven to have an initialization period t1, a detection voltage charging period t2, and a voltage detection period t3.

During the initialization period t1, the first and second gate signals GSa and GSb of gate-on voltage level are respectively supplied to the first and second gate lines Ga and Gb by the aforementioned row driver 124; and the detection data voltage Vdata converted from the detection pixel data DATA is supplied to the data line Di by the column driver 122, and the pre-charging voltage Vpre is supplied to the detection line Mi by the column driver 122, at the same time.

Accordingly, as the first and second switching transistors ST1 and ST2 for each pixel P are respectively turned-on by the first and second gate signals GSa and GSb of gate-on voltage level, the data voltage Vdata is supplied to the first node n1, and the voltage of the second node n2 is initialized to the pre-charging voltage Vpre, whereby the capacitor Cst is charged with the differential voltage Vdata-Vref between the data voltage Vdata and the pre-charging voltage Vpre.

During the detection voltage charging period t2, the first and second gate signals GSa and GSb of gate-on voltage level are respectively supplied to the first and second gate lines Ga and Gb by the aforementioned row driver 124; and the detection data voltage Vdata is supplied to the data line Di by the column driver 122, and the detection line Mi becomes floating. Accordingly, the during the detection voltage charging period t2, the driving transistor DT is turned-on by the detection data voltage Vdata, and the detection line Mi of the floating state is charged with the voltage corresponding to the current flowing in the turned-on driving transistor DT. In this case, the detection line Mi is charged with the voltage corresponding to a threshold voltage, that is, one characteristic of the driving transistor DT.

During the voltage detection period t3, the first gate signal GSa of gate-off voltage level is supplied to the first gate line Ga by the row driver 124, the second gate signal of gate-on voltage level is supplied to the second gate line Gb by the row driver 124, and the floating detection line Mi is connected to the column driver 122, at the same time. Accordingly, during the voltage detection period t3, the column driver 122 detects the voltage charged in the connected detection line Mi; and converts the detected voltage, that is, the voltage corresponding to the threshold voltage of the driving transistor DT, into the detection data Dsen, and then supplies the detection data Dsen to the timing controller 126.

Meanwhile, the timing controller 126 detects the threshold voltage of the driving transistor DT for each pixel P through the detection mode, and re-performs the detection mode to detect the mobility of the driving transistor DT for each pixel P. In this case, when the timing controller 126 identically performs the aforementioned detection mode, the timing controller 126 controls the column driver 122 and the row driver 124 so as to turn-on the first switching transistor ST1 for each pixel P only during the initialization period t1 and to supply the detection data voltage Vdata only during the initialization period t1.

For the re-performance of the detection mode, as the gate-source voltage of the driving transistor DT is raised due to the turned-off first switching transistor ST1 during the detection voltage charging period t2, the gate-source voltage of the driving transistor DT is maintained by the voltage of the capacitor Cst, whereby the floating detection line Mi is charged with the voltage corresponding to the current flowing in the driving transistor DT, that is, the voltage corresponding to the mobility of the driving transistor DT. For the re-performance of the detection mode, the column driver 122 detects the voltage charged in the detection line Mi, that is, the voltage corresponding to the mobility of the driving transistor DT; and converts the detected voltage into the detection voltage Dsen, and then supplies the detection voltage Dsen to the timing controller 126.

As the sensor 130 according to the present invention performs the detection mode only when there exists no user around the display panel 110, the sensor 130 generates the detection data Dsen corresponding to the characteristics of the driving transistor DT for each pixel P through the plurality of detection lines M1 to Mi, and drives the pixel P by reflecting the input data Idata after completing the generation of the detection data corresponding to the characteristics of the driving transistor DT for all of the pixels P, whereby a user can not perceive un-uniformity of displayed image by the compensation of the input data.

Hereinafter, a method for operating the organic light emitting display device according to one embodiment of the present invention will be described with reference to FIG. 12.

Figure 12:
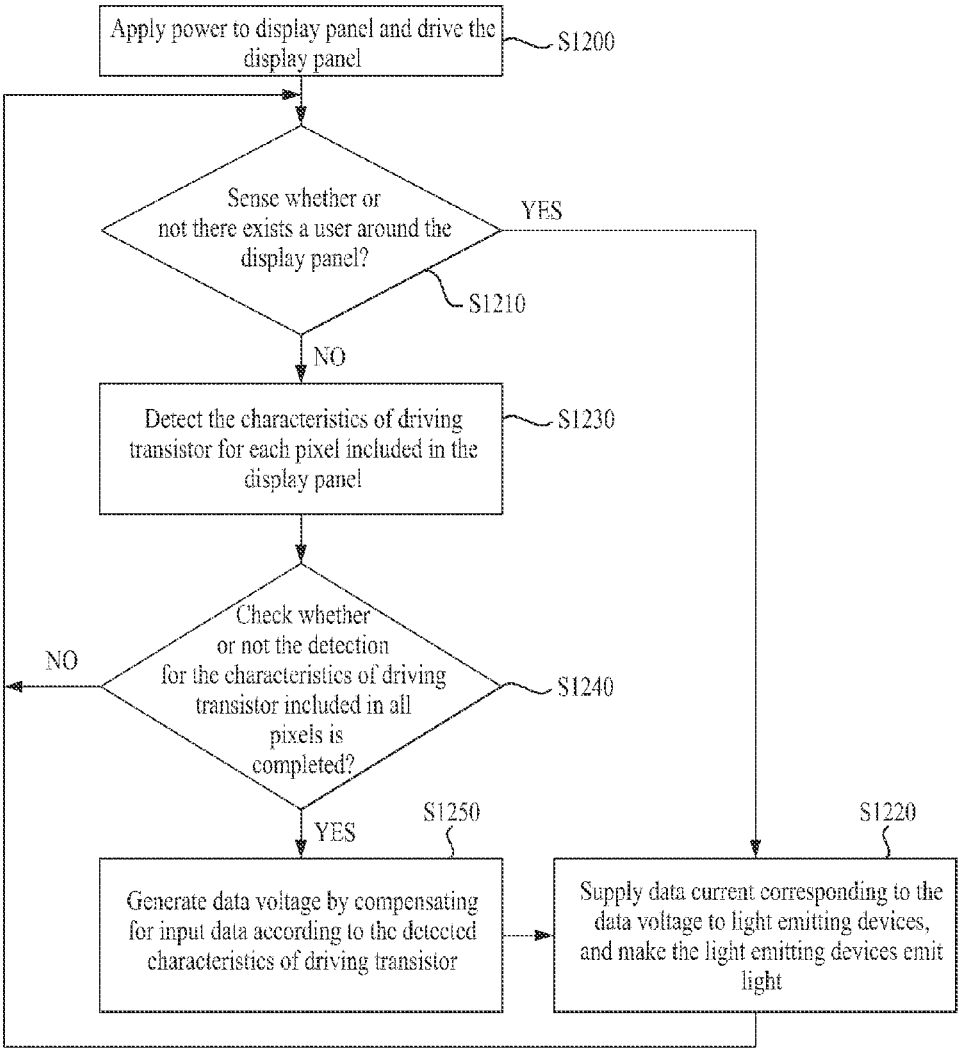
FIG. 12 is a flow chart illustrating a method of operating the organic light emitting display device according to one embodiment.

FIG. 12 is a flow chart illustrating a method for operating the organic light emitting display device according to one embodiment of the present invention.

First, the display panel is driven by applying power thereto (S1200). Then, it is determined whether or not there exists a user around the driven display panel (S 1210). According to one embodiment of the present invention, whether or not there exists a user around the display panel may be determined by the use of at least one of a thermal sensor, an infrared sensor, and a photo sensor.

For example, if using the thermal sensor, it is determined whether or not there exists a user around the display panel by the temperature change sensed through the thermal sensor. According to another example, if using the photo sensor, whether or not there exists a user around the display panel is determined by comparing an Nth image and an (N−1)th image taken by the use of photo sensor with each other.

Based on the determination result of S1210, when it is determined that there exists a user around the display panel, the display panel is operated in the display mode, and the data current corresponding to the data voltage is supplied to the light emitting devices included in each of the pixels included in the display panel, to thereby make the light emitting device emit light (S1220).

Based on the determination result of S1210, when it is determined there exists no user around the display panel, the display panel is operated in the detection mode, thereby detecting the characteristics of driving transistor DT including at least one of the mobility and the threshold voltage of the driving transistor for each of the pixels included in the display panel (S 1230).

According to one embodiment of the present invention, the detection for the characteristics of driving transistor may be performed by each horizontal line according to the detection order previously determined for the horizontal lines included in the display panel. Although not shown in FIG. 12, the method of operating the organic light emitting display device according to one embodiment of the present invention may further include a process of determining the detection order for the horizontal lines.

In this case, the detection order previously determined for the horizontal lines may be determined according to frequency component and luminance of the pixels included in each horizontal line.

In more detail, if the detection order is determined in order of average luminance of the pixels included in each horizontal line, the detection order is determined in the sequential order from the horizontal line with the highest average luminance to the horizontal line with the lowest average luminance.

If the detection order is determined based on the frequency component of the pixels included in each horizontal line, the detection order is determined in the sequential order from the horizontal line with the highest representative frequency value to the horizontal line with the lowest representative frequency value. In this case, the representative frequency value for each horizontal line means the highest frequency component when the luminance values of the pixels included in each horizontal line are converted into the frequency components.

Then, it is determined whether or not the detection for the characteristics of the driving transistor DT for all the pixels is completed (S1240). If the detection for the characteristics of the driving transistor for all of the pixels is completed, the data voltage is generated by compensating for the input data according to the detected characteristics of the driving transistors (S 1250).

Thereafter, the data current corresponding to the data voltage generated in the step of S1250 is supplied to the light emitting device of the display panel, whereby the light emitting device emits light (S1220).

Based on the determination result of S1240, if the detection for the characteristics of the driving transistor for all the pixels included in each horizontal line is not completed, the process returns to S1210, and the following steps after S1210 are repeated. In this case, under the condition that the detection for the characteristics of the driving transistor for the pixels included in the horizontal line is partially completed, if it is determined that there exists a user around the display panel, the detection for the characteristics of the driving transistors is stopped, and the process of S1220 is performed so that the display panel is operated in the display mode.

After that, when it is determined that there exists no user around the display panel, the characteristics of the driving transistor for the pixels included in the next horizontal line, which corresponds to the horizontal line next to the corresponding horizontal line whose detection is completed based on the detection order, is detected.

The above method of operating the organic light emitting display device may be realized in a program type performed by the use of various computer means. In this case, a program for performing the method of operating the organic light emitting display device may be stored in a non-transitory computer readable storage medium read by the use of a computer, such as a hard disk, a CD-ROM, a DVD, ROM, RAM, or flash memory.

According to the present invention, the variation in the characteristics of a driving transistor DT, which is detected for each pixel, is reflected in the input data so that the variation in the characteristics of the driving transistor included in each pixel is compensated for periodically or in real-time, thereby improving uniformity of luminance.

Also, the variation in the characteristics of a driving transistor DT is detected only during the time period when there exists no user around the display panel, and the variation in the characteristics of the driving transistor is compensated for after completing the detection for the variation in the characteristics of all of the driving transistors. Thus, it is possible to improve satisfaction with picture quality because a user can not perceive the change of uniformity in the displayed image by the compensation of the input data.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a display panel including a plurality of pixels, wherein each pixel has a driving transistor for operating a light emitting device so as to make the light emitting device emit light with a data current corresponding to a data voltage;

a panel driver for detecting characteristics of the driving transistor included in each pixel including at least one of mobility and threshold voltage of the driving transistor during a time period when there exists no user around the display panel, generating compensated input data by compensating input data according to the characteristics after the detection of the characteristics of the driving transistor included in each pixel is completed, and generating the data voltage through the use of the compensated input data; and a sensor for sensing whether or not there exists a user around the display panel, and supplying the sensing result to the panel driver, wherein the panel driver converts luminance values of pixels included in each horizontal line into frequency components, determines a highest frequency component as a representative frequency value for each horizontal line, and sequentially determines a detection order to detect the characteristics of driving transistor from the horizontal line with the high representative frequency value to the horizontal line with the low representative frequency value.

2. The device of claim 1, wherein the sensor senses whether or not there exists a user around the display panel by the use of at least one of a thermal sensor, an infrared sensor, and a photo sensor.

3. A method of operating an organic light emitting display device comprising:

determining a detection order to detect the characteristics of driving transistor included in each pixel;

detecting characteristics of driving transistors according to the detection order during a time period when there exists no user around a display panel, the characteristics including at least one of mobility and threshold voltage of the driving transistor;

generating a data voltage by compensating for input data according to the characteristics after the detection for the characteristics of driving transistors included in each pixel is completed; and supplying a data current corresponding to the data voltage to a light emitting device included in the display panel so as to make the light emitting device emit light, wherein in the step of determining the detection order, luminance values of the pixels included in each horizontal line are converted into frequency components, the highest frequency component is determined as a representative frequency value for each horizontal line, and the detection order is determined to be in sequential order from the horizontal line with the high representative frequency value to the horizontal line with the low representative frequency value.

4. The method of claim 3, further comprising sensing whether or not there exists a user around the display panel through at least one of a temperature change sensed by use of a thermal sensor, and a change of image taken by use of a photo sensor.

5. An organic light emitting display device comprising:

a display panel including a plurality of pixels, wherein each pixel has a driving transistor for operating a light emitting device so as to make the light emitting device emit light with a data current corresponding to a data voltage; and a panel driver for detecting the characteristics of driving transistor including at least one of mobility and threshold voltage of the driving transistor included in each pixel, compensating for input data according to a detection result after the detection for the characteristics of driving transistor included in each pixel is completed, and generating the data voltage through the use of compensated input data, wherein the panel driver includes a scheduler for determining a detection order to detect the characteristics of driving transistor, and wherein the scheduler converts luminance values of the pixels included in each horizontal line into frequency components, determines a highest frequency component as a representative frequency value for each horizontal line, and sequentially determines a detection order from the horizontal line with the high representative frequency value to the horizontal line with the low representative frequency value.

6. The device of claim 5, wherein the panel driver detects the characteristics of driving transistor during a time period when there exists no user around the display panel.

7. The device of claim 6, further comprising a sensor for sensing whether or not there exists a user around the display panel, and supplying the sensing result to the panel driver.

8. The device of claim 7, wherein the sensor senses whether or not there exists a user around the display panel by the use of at least one of a thermal sensor, an infrared sensor, or a photo sensor.

9. A method of operating an organic light emitting display device comprising:

determining a detection order to detect characteristics of driving transistor included in each pixel;

detecting the characteristics of driving transistor including at least one of mobility and threshold voltage of the driving transistor according to the detection order;

generating a data voltage by compensating for input data according to a detection result after the detection for the characteristics of driving transistor included in each pixel is completed; and supplying a data current corresponding to the data voltage to a light emitting device included in the display panel so as to make the light emitting device emit light, wherein the step of determining the detection order comprises:

converting luminance values of pixels included in each horizontal line into frequency components;

determining a highest frequency component as a representative frequency value for each horizontal line; and determining the detection order to be in sequential order from the horizontal line with the high representative frequency value to the horizontal line with the low representative frequency value.

10. The method of claim 9, wherein characteristics of driving transistor are detected during a time period when there exists no user around a display panel.

11. The method of claim 10, further comprising sensing whether or not there exists a user around the display panel.

12. The method of claim 11, wherein in the step of sensing, it is sensed whether or not there exists the user around the display panel through a temperature change sensed by use of a thermal sensor or through a change of image taken by use of a photo sensor.

* * * * *